US005182824A

United States Patent [19]

Cipriano

[11] Patent Number: 5,182,824

[45] Date of Patent: Feb. 2, 1993

[54] WRESTLING BED

[76] Inventor: Nickolas A. Cipriano, 1021 Marlyn Rd., Philadelphia, Pa. 19151

[21] Appl. No.: 928,065

[22] Filed: Aug. 11, 1992

[51] Int. Cl.[5] ..... A47D 11/00

[52] U.S. Cl. ..... 5/2.1; 5/400; 5/425; 5/181

[58] Field of Search ..... 5/2.1, 658, 400, 411, 5/425, 93.1, 93.2, 181, 420; 472/93

[56] References Cited

U.S. PATENT DOCUMENTS

| | | | |
|---|---|---|---|
| D. 252,599 | 8/1979 | Carter | 5/658 |
| 485,896 | 11/1892 | Sterry | 472/93 |
| 1,753,328 | 4/1930 | Barnes | 472/93 |
| 2,231,381 | 2/1941 | Boehmcke | 5/425 |
| 2,243,943 | 6/1941 | Bunting | 472/93 |
| 2,267,865 | 12/1941 | Hurley . | |
| 2,586,251 | 2/1952 | Peebles | 5/2.1 |
| 2,705,331 | 4/1955 | Cone . | |
| 2,726,866 | 12/1955 | Nally . | |
| 3,327,328 | 6/1967 | Slivoski | 5/181 |
| 4,106,138 | 8/1978 | Murphy | 5/400 |
| 4,361,919 | 12/1982 | Hull | 5/2.1 |
| 4,767,419 | 8/1988 | Fattore . | |
| 4,841,586 | 6/1989 | Jester | 5/400 |
| 4,945,586 | 8/1990 | Cross et al. . | |

*Primary Examiner*—Renee S. Luebke

*Assistant Examiner*—Flemming Saether

*Attorney, Agent, or Firm*—Richard C. Litman

[57] ABSTRACT

A wrestling bed provides a defined and restricted area for childrens's vigorous activities, thus serving to protect other articles from accidental damage due to such vigorous play. The wrestling bed is solidly constructed in order to resist damage from active play, which might damage standard bed frames. The wrestling bed includes a platform sized to provide a central area fitting a mattress of standard configuration and includes peripheral tread pads, corner posts and padding, peripheral ropes, and steps at one side of the platform. The wrestling bed has the general appearance of a wrestling or boxing ring, thereby lending some realism to children's wrestling or play therein, while providing copious padding and protection for children playing therein. The mattress, although substantially softer and more resilient than a real wrestling ring surface, provides greater protection and further doubles as a standard bedding mattress. A protective cover may be tucked in around the edges of the mattress for play, or the wrestling bed may be made up in the manner of a standard bed for sleep. The protective cover may be left in place beneath the standard bedding in order to protect the mattress in the event of incontinence.

19 Claims, 3 Drawing Sheets

WRESTLING BED

FIELD OF THE INVENTION

The present invention relates generally to beds and other structures and furnishings for sleeping, and more specifically to a bed providing a durable construction and features permitting further use as a wrestling ring or for other appropriate sports, especially for use by active children.

BACKGROUND OF THE INVENTION

It is well known that children are generally quite energetic and playful; parents often find it difficult to channel or redirect that energy in a harmess direction. Oftentimes the result of innocent (although active and energetic) play, is damage to articles or furnishings, particularly when such play is done indoors. It can prove difficult to find furnishings and other articles which are capable of withstanding the results of children's physical play and activities.

Boys are particularly fond of wrestling and other contact sports, and to a small boy a bed or mattress may appear to serve as a suitable mat for wrestling or other contact or gymnastic sports. It is likely that virtually all normal boys have used their beds as wrestling or tumbling mats at some time or another, usually much to the dismay of their parents who fear for the durability of the structure of the bed frames. Small children cannot always be expected to understand such concerns, and further may redirect such physical activities to other areas which may not be so forgiving of hard impacts as a bed. The injuries which may result can be dismaying to say the least.

On the other hand, few families can afford an additional dedicated article of furniture or the like, specifically adapted for use as a wrestling, tumbling or gymnastic mat for their children. The additional space along which would be required is beyond the capability of the average household to provide. What is needed is a bed or similar article which is specifically constructed to provide a structure sufficiently durable to withstand the extreme physical activities of children when used as a play or wrestling area. The bed structure must provide for a mattress of standard configuration in order to allow use as a bed, but must also include sufficient padding to preclude inadvertent injury to children using the bed as a play or wrestling area. Peripheral retaining means must also be provided (e.g., plural strands of rope as in conventional wrestling or boxing rings) both in order to provide safety for children using the wrestling bed and further to provide a realistic appearance for the bed as a wrestling mat or ring.

DESCRIPTION OF THE PRIOR ART

U.S. Pat. No. 2,267,865 issued to John F. Hurley on Dec. 30, 1941 discloses a Portable Platform intended for use as a structure for a boxing ring or the like. The structure and materials are unlike those of the present invention.

U.S. Pat. No. 2,705,331 issued to William D. Cone on Apr. 5, 1955 discloses a Foldable And Rollable Bunk. A central support at each end allows the beds to pivot to a vertical plane for storage against a wall. The structure is unrelated to the present invention.

U.S. Pat. No. 2,726,866 issued to Duke H. Nally on Dec. 13, 1955 discloses a Knock-Down Platform Construction for a boxing ring or the like. The structure differs from the present invention in that the platform is intended to function as a full scale boxing ring.

U.S. Pat. No. 4,767,419 issued to Mary E. Fattore on Aug. 30, 1988 discloses a Protective Pad For Crib Rail. The pad is intended to produce a sound when pressure is applied, and bears no resemblance to any of the structure of the present invention other than to teach the general concept of padding.

U.S. Pat. No. 4,945,586 issued to Ramon Cross et al. on Aug. 7, 1990 discloses a Canopy Bed Frame Assembly. Corner posts support peripheral curtains, but no disclosure is provided of retaining ropes support thereby.

Finally, U.S. Pat. No. 4,991,244 issued to Robert A. Walker on Feb. 12, 1991 discloses a Border For Air Bed having a double density peripheral pad. No resemblance is seen to the structure of the present invention.

None of the above noted patents, taken either singly or in combination, are seen to disclose the specific arrangement of concepts disclosed by the present invention.

SUMMARY OF THE INVENTION

By the present invention, an improved bed suitable for use as a wrestling or play mat or area is disclosed.

Accordingly, one of the objects of the present invention is to provide a wrestling bed having a durable structure resistant to damage from such use.

Another of the objects of the present invention is to provide a wrestling bed which is adapted to use with a mattress of conventional configuration, the mattress serving as both a mat or pad for wrestling or play and further as a mattress for the bed.

Yet another of the objects of the present invention is to provide a wrestling bed which includes peripheral padding surrounding the mattress for additional safety.

Still another of the objects of the present invention is to provide a wrestling bed which includes corner posts and peripheral ropes thereon for additional safety.

A further object of the present invention is to provide a wrestling bed which includes protective padding at the corner posts.

An additional object of the present invention is to provide a wrestling bed which is constructed specifically to provide a compact size for installation in a standard bedroom, yet still providing sufficient room within the perimeter for use as a wrestling or play area or for use as a bed.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
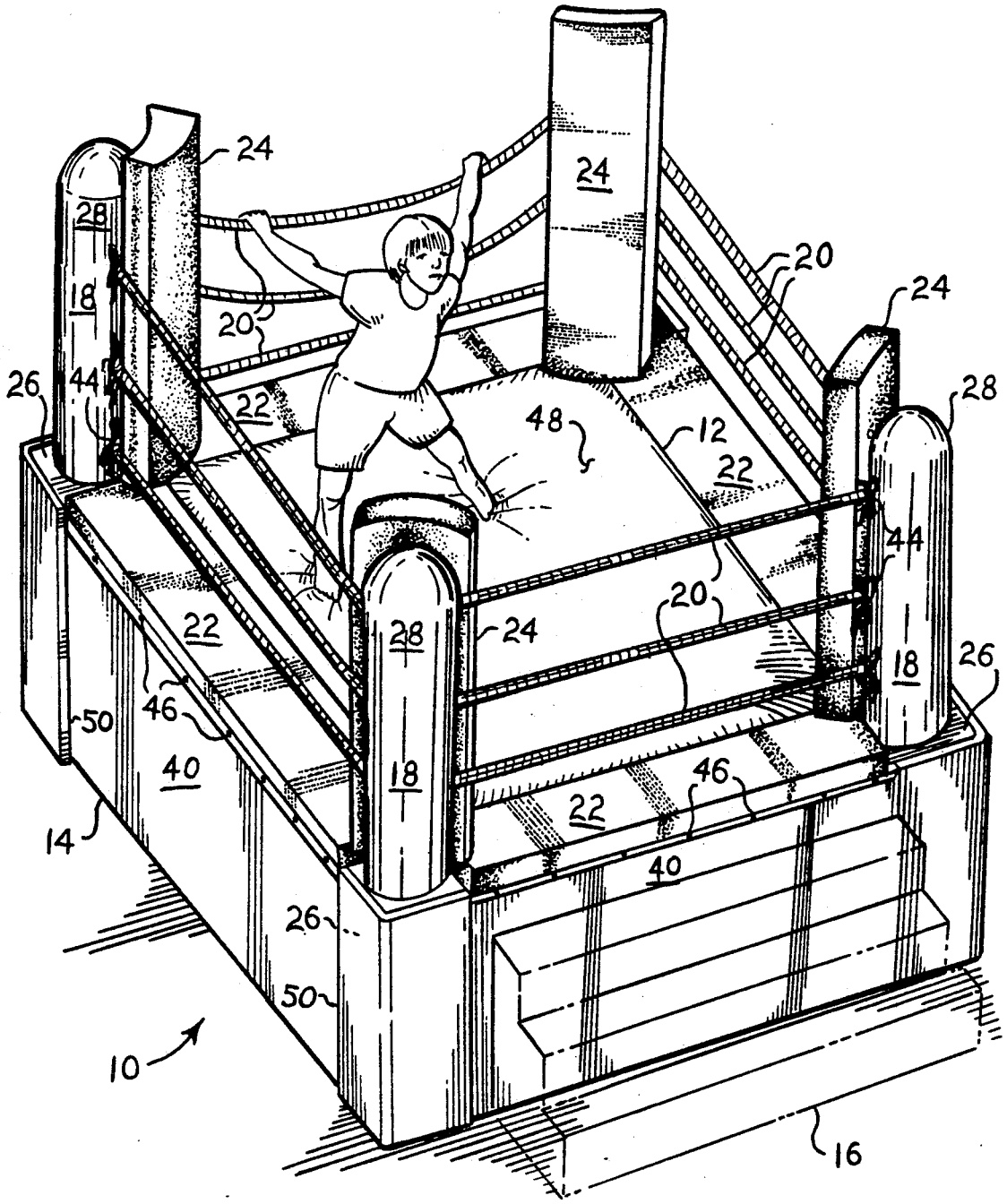
FIG. 1 is a perspective view of the wrestling bed of the present invention in use, showing its various features.

Referring now to the drawings, particularly FIG. 1 of the drawings, the present invention will be seen to relate to a wrestling bed 10 in the general configuration of a wrestling or boxing ring. However, wrestling bed 10 will be seen to possess many novel features not found in conventional wrestling rings and the like, due to its relatively small size and dual function as a child's bed.

Wrestling bed 10 is constructed in a size and shape configured to contain a mattress 12 of standard configuration. Wrestling bed 10 obviously may be constructed to virtually any desired size. Preferably, however, wrestling bed 10 will be constructed to properly fit a standard matress 12 of twin, double, queen or king size, according to the size of the wrestling bed 10 desired. Obviously, wrestling bed 10 may be made in other sizes and custom mattresses made to fit such non standard sizes.

The other basic components of wrestling bed 10 comprise a raised platform 14, four corner posts 18, peripheral retaining ropes 20, and peripheral tread pads 22. Additional corner post pads 24 may be secured to corner posts 18 facing the interior of wrestling bed 10, and steps 16 may be added for ease of access and to provide a more realistic appearance.

Figure 2:
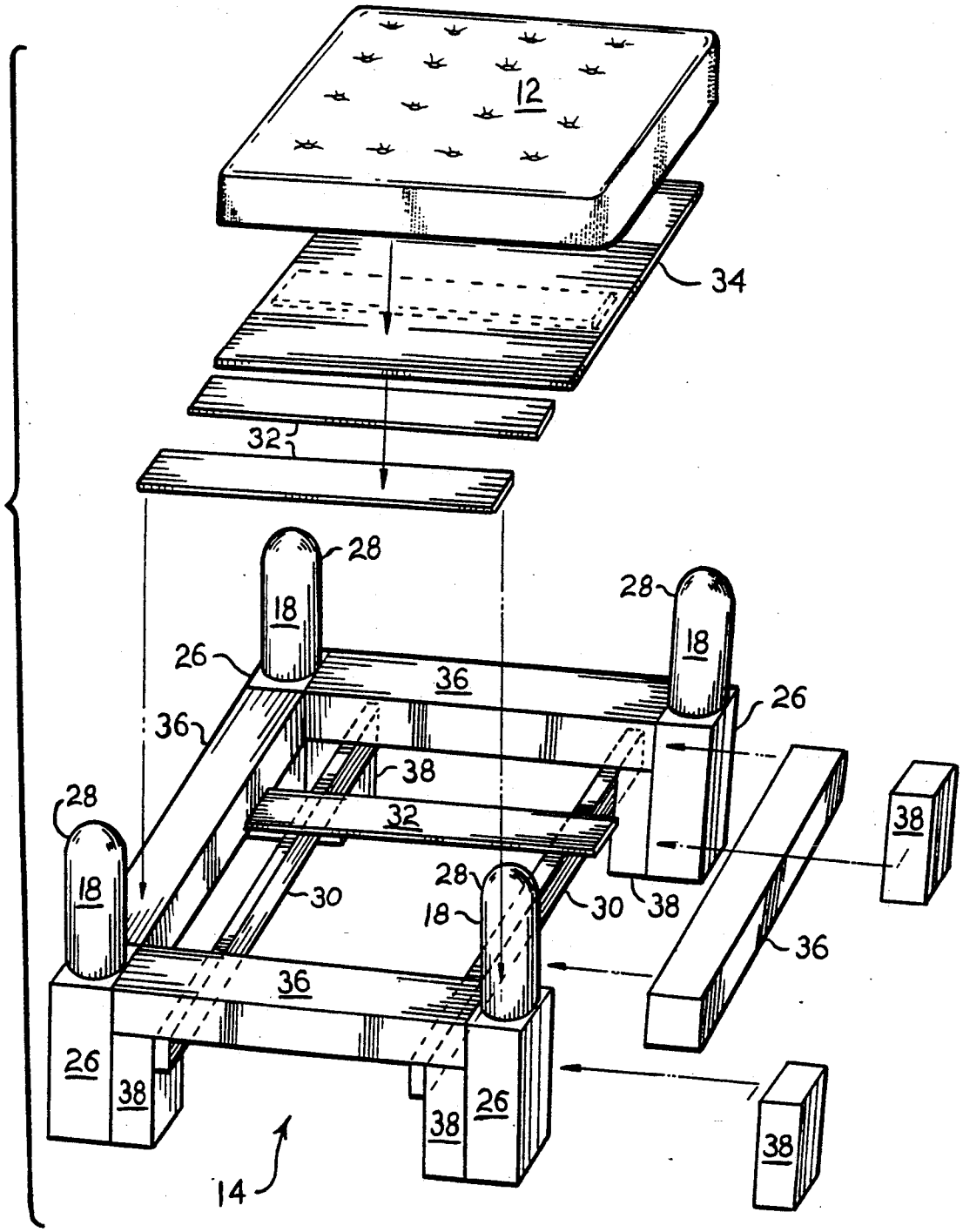
FIG. 2 is an exploded perspective view of the structure of the wrestling bed.

FIG. 2 of the drawings provides a view of the structure of wrestling bed 10. The lower portions 26 of the four corner posts 18 also serve to support the remaining structure of wrestling bed 10. Corner post lower portions 26 will be seen to be square or rectangular in section, in order to better secure the remaining structural members thereto, while the corner post upper portions 28 which extend above the upper surface of mattress 12 will be seen to be rounded or cylindrical, in order to eliminate any sharp edges. Peripheral cross members 36 extend between orthogonally opposite corner posts 18, in order to provide a basic rectangular structure for wrestling bed 10. These peripheral cross members 36 are further supported by corner supports 38 which are secured to mutually facing sides of opposite corner posts 18. Peripheral cross members 36 are secured to and rest upon the upper ends of corner supports 38.

Lower cross members 30 are secured to the mutually facing sides of opposite corner supports 38, which lower cross members 30 support a plurality of bed floor planks 32. Floor planks 32 in turn support an overlying bed floor 34 of plywood sheathing or other suitable material, which floor 34 serves as a base for mattress 12. Corner posts 18 and the remaining components comprising the structure of platform 14 are preferably formed of wood such as construction grade pine or fir, but obviously other materials may be used including steel angles and/or extruded shapes of various configurations.

Floor 34 extends only to the inner edges of peripheral cross members 36, thereby providing a rectangular periphery equal to the width of cross members 36. Floor planks 32, and thus floor 34 which rests thereupon, will be seen to have upper surfaces which reside somewhat below the upper surfaces of peripheral cross members 36. The higher peripheral cross members 36 accomplish two functions by means of their higher upper surfaces: (1) they provide retention for mattress 12 in order to prevent mattress 12 from slipping from wrestling bed 10 due to vigorous play or activity, and (2) they provide an attachment surface for peripheral tread pads 22.

Typically, peripheral cross members 36 will be formed of material such as "four by four" lumber, which nominal size in combination with the thickness of planks 32 and floor 34, will result in floor 34 residing some three inches or so below the upper surfaces of peripheral cross members 36. However, when a mattress 12 is placed upon floor 34, the upper surface of mattress 34 will typically be some three inches or so above the upper surfaces of peripheral cross members 36. This is desirable, as it is necessary to provide some additional peripheral padding to the upper surfaces of cross members 36 in order to further protect persons using wrestling bed 10. The thickness of such peripheral padding as tread pads 22 (shown in FIG. 1) is formed so as to provide an upper surface which lies in the same plane as the upper surface of mattress 12, thus providing an essentially continuous level and even upper surface for wrestling bed 10. This continuous level surface provides for safer footing for children or persons playing or wrestling upon wrestling bed 10, in that there is far less likelihood of a person tripping over the discontinuity between the edge of mattress 12 and tread pads 22.

Figure 3:
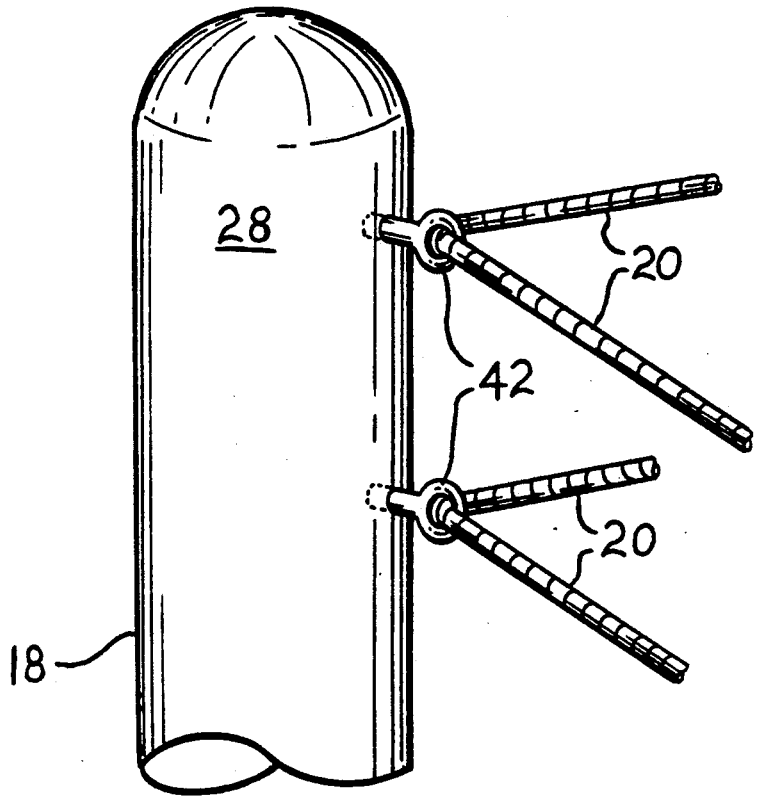
FIG. 3 is a broken away perspective view of a corner post, showing the rope attachment detail.

Further safety features are provided by the rounded upper portions 28 of corner posts 18, as noted above. Preferably, the lower portions 26 and upper portions 28 of corner posts 18 are formed of a single piece of material for greater strength. Peripheral ropes 20 are secured directly to the inner surface of each corner post 18 (i.e., the surfaces of corner posts 18 which are facing the center of wrestling bed 10) by means of eye bolts 42 as shown in FIG. 3, or by other suitable means. The tension thus developed as ropes 20 are pulled taut between corner posts 18, would tend to draw corner posts 18 inward and toward one another. This tensile force is countered by the lower cross members 30 and peripheral cross members 36 extending between opposite corner posts 18, and exterior sheathing 40 shown in FIG. 1, as well as by other structural members of wrestling bed 10. Thus, the monolithic nature of each corner post 10 provides for a stronger structure able to resist the tensile forces of ropes 20 and any additional forces imparted thereto while wrestling bed 10 is in use as a play area. An additional corner fascia material 50 of plastic or other suitable material may be installed over the exterior sheathing 40 at the lower portions 26 of corner posts 18, to provide protection for those portions of wrestling bed 10 and to provide a more finished appearance for the corners, as well as to prevent possible injury due to hard contact with the corners.

As noted above, ropes 20 are secured directly to corner posts 18 by means of eye bolts 42, rather than by means of additional diagonally arrayed standoffs or turnbuckles as is known in the art of full scale wrestling or boxing rings. Thus, the ropes 20 will be seen to overlie the periphery of mattress 12 and define a play area over mattress 12, rather than encroaching upon the area of mattress 12 and further limiting the play or wrestling area provided by wrestling bed 10. The structure of wrestling bed 10 thus provides a maximized play or wrestling area essentially the size of mattress 12, while further providing an overall size only slightly larger than a standard bed constructed to fit a similarly sized mattress 12. The only additional space required over the area taken by mattress 12, is the space defined by the projected area between corner posts 18. This space is protected by tread pads 22, as described above.

In order to preclude the possibility of injury from the eye bolts 42 used to secure ropes 20 to corner posts 18, corner post pads 24 are secured to ropes 20 at each side of each corner post 18 as shown in FIG. 1. Corner post pads 24 are secured to ropes 20 by means of ties 44; other means may be used alternatively. In a like manner, tread pads 22 may be secured to the upper sides of platform 14 by means of snap fasteners 46 in order to prevent any undesirable displacement of tread pads 22 during any vigorous play upon wrestling bed 10. Further security may be achieved by securing the inner portions of tread pads 22 to the corresponding inner sides of peripheral cross members 36. Preferably, tread pads 22 and corner post pads 24 are covered with a durable, moistureproof material (e.g., vinyl) for ease of cleanup and protection of the padding material contained therein. Mattress 12 may also be covered with a removable protective sheet 48 in order to provide for easier cleanup and prevent tears or damage to the surface of mattress 12. While such a protective sheet 48 may be removed when wrestling bed 10 is used for sleeping, the sheet 48 may alternatively be left in place beneath any bed sheets, mattress pad, etc. in order to protect the mattress 12 in the event of incontinence.

Wrestling bed 10 is preferably used as a wrestling or play area with any bedding (other than mattress 12 and overlying protective sheet 48) removed in order to prevent wear and tear to such bedding. The peripheral ropes 20 and corner posts 18 provide a realistic appearance for children playing upon wrestling bed 10, while simultaneously precluding the expansion of any wrestling or vigorous play from extending beyond the area defined by ropes 20 and possibly endangering other articles in the room. When it is desired to use wrestling bed 10 as a bed, a mattress pad (if desired), lower sheet, top sheet, blanket(s) as desired, pillows and spread may be arranged upon the surface of mattress 12 and tread pads 22, with the sheets and/or blankets either tucked in to the gap between mattress 12 and tread pads 22 or draped over the outer edge of wrestling bed 10, as desired. The use of a mattress 12 of standard configuration, while not providing a surface as firm as a standard wrestling or boxing ring, will be seen to provide greater protection for children playing upon wrestling bed 10 while also providing a relatively economical unit due to the use of a single mattress 12 for both a wrestling or play surface and for sleeping.

It is to be understood that the present invention is not limited to the sole embodiment described above, but encompasses any and all embodiments within the scope of the following claims.

I claim:

1. A wrestling bed comprising:

a rectangular platform supporting a mattress of standard configuration;

four corner posts defining corners of said rectangular platform and extending upward therefrom;

four peripheral tread pads extending between said corner posts and surrounding said mattress, said mattress having a periphery immediately adjacent said tread pads;

a plurality of peripheral ropes extending between said corner posts and secured thereto, said peripheral ropes overlying said periphery of said mattress and defining a play area thereupon; whereby, said wrestling bed provides a defined area for vigorous activities by means of said platform, said corner posts, and said retaining ropes and further provides a bed by means of said platform and said mattress.

2. A wrestling bed according to claim 1 including:

a plurality of steps immediately adjacent said rectangular platform.

3. A wrestling bed according to claim 1 wherein:

said mattress and said tread pads have upper surfaces lying in the same plane.

4. A wrestling bed according to claim 1 wherein:

said rectangular platform is formed of two lower cross members extending between opposite said corner posts with said lower cross members supporting a plurality of floor planks and said floor planks supporting floor sheathing, said floor sheathing providing a bed floor with said bed floor supporting said mattress.

5. A wrestling bed according to claim 4 further including:

exterior sheathing secured to said corner posts and extending therebetween.

6. A wrestling bed according to claim 5 wherein:

said exterior sheathing is formed of wood.

7. A wrestling bed according to claim 4 wherein:

said lower cross members, said corner posts, said floor planks and said floor sheathing are formed of wood.

8. A wrestling bed according to claim 1 wherein:

said rectangular platform and said corner posts are constructed of wood.

9. A wrestling bed according to claim 1 wherein:

said mattress and said tread pads have upper surfaces lying in the same plane.

10. A wrestling bed according to claim 9 wherein:

said platform includes four peripheral cross members having upper surfaces higher than said floor sheathing.

11. A wrestling bed according to claim 10 wherein:

said mattress and said tread pads have upper surfaces lying in the same plane.

12. A wrestling bed according to claim 1 including:

a protective sheet overlying said mattress.

13. A wrestling bed according to claim 1 including:

corner post pads secured to said ropes and facing said play area defined by said ropes and said mattress.

14. A wrestling bed according to claim 1 including:

means for securing said ropes directly to said corner posts immediately within said corner posts and overlying said periphery of said mattress, whereby said play area defined by said ropes and said mattress is maximized.

15. A wrestling bed according to claim 14 wherein:

said means for securing said ropes directly to said corner posts comprise eye bolts, said eye bolts secured within said corner posts and said ropes passing through said eye bolts and lying immediately adjacent said corner posts.

16. A wrestling bed according to claim 1 wherein:

said corner posts include an upper portion of cylindrical section.

17. A wrestling bed according to claim 1 including:

corner fascia at each said corner post.

18. A wrestling bed according to claim 17 wherein:

said corner fascia are formed of plastic material.

19. A wrestling bed comprising:

a rectangular platform supporting a mattress of standard configuration;

four corner posts defining corners of said rectangular platform and extending upward therefrom;

said corner posts each having a lower portion with exterior sheathing secured thereto and extending therebetween;

each said lower portion of said corner posts further having a corner fascia of plastic material;

said corner posts including an upper portion of cylindrical section;

said platform including four peripheral cross members extending between orthogonally opposite said corner posts;

said platform further including two oppositely spaced lower cross members extending between opposite said corner posts;

said lower cross members supporting a plurality of floor planks and said floor planks supporting floor sheathing, said floor sheathing providing a bed floor with said bed floor supporting said mattress;

a plurality of steps immediately adjacent said rectangular platform;

said lower cross members, said corner posts, said floor planks, said floor sheathing, said steps and said exterior sheathing formed of wood;

four peripheral tread pads extending between said corner posts and surrounding said mattress, said mattress having a periphery immediately adjacent said tread pads;

said peripheral cross members having upper surfaces higher than said floor sheathing, whereby said mattress and said tread pads have upper surfaces lying in the same plane;

said mattress having a protective sheet overlyingly disposed;

a plurality of peripheral ropes extending between said corner posts and secured thereto, said peripheral ropes overlying said periphery of said mattress and defining a play area thereupon;

corner post pads secured to said ropes and facing said play are defined by said ropes and said mattress;

means for securing said ropes directly to said corner posts comprising eye bolts, said eye bolts secured within said corner posts and said ropes passing through said eye bolts and lying immediately adjacent said corner posts, whereby;

said wrestling bed provides a defined area for vigorous activities by means of said platform, said corner posts, and said retaining ropes and further provides a bed by means of said platform and said mattress.

* * * * *